US007636047B1

(12) United States Patent
Sempek

(10) Patent No.: US 7,636,047 B1
(45) Date of Patent: Dec. 22, 2009

(54) APPARATUS FOR MONITORING A MOBILE OBJECT INCLUDING A PARTITIONABLE STRAP

(75) Inventor: David Sempek, Omaha, NE (US)

(73) Assignee: iSECUREtrac Corp., Omaha, NE (US)

( * ) Notice: Subject to any disclaimer, the term of this patent is extended or adjusted under 35 U.S.C. 154(b) by 357 days.

(21) Appl. No.: 11/729,318

(22) Filed: Mar. 28, 2007

Related U.S. Application Data

(60) Provisional application No. 60/787,364, filed on Mar. 30, 2006.

(51) Int. Cl.
*G08B 13/14* (2006.01)

(52) U.S. Cl. ..... 340/572.8; 340/572.1

(58) Field of Classification Search ..... 340/572.1, 340/572.8, 572.4
See application file for complete search history.

(56) References Cited

U.S. PATENT DOCUMENTS 5,936,529 A * 8/1999 Reisman et al. ..... 340/573.1
6,346,886 B1 * 2/2002 De La Huerga ..... 340/573.1

* cited by examiner

*Primary Examiner*—Jeffery Hofsass
(74) *Attorney, Agent, or Firm*—Suiter Swantz pc llo

(57) ABSTRACT

An apparatus for monitoring a mobile object comprising a strap suitable for engaging with a portion of said mobile object. The strap said strap comprises a tamper-detection assembly, a transceiving assembly suitable for two-way communication, and a tamper-resistant housing. The tamper resistant housing is configured to secure the transceiving assembly. The tamper resistant housing further secures a first end and a second end of the strap with the portion of the mobile object and the housing comprises a partitioning assembly suitable for partitioning the strap.

20 Claims, 13 Drawing Sheets

APPARATUS FOR MONITORING A MOBILE OBJECT INCLUDING A PARTITIONABLE STRAP

CROSS REFERENCE TO RELATED APPLICATIONS

The present application claims the benefit under 35 U.S.C. § 119 of U.S. Provisional Application Ser. No. 60/787,364 filed Mar. 30, 2006. Said U.S. Provisional Application Ser. No. 60/787,364 filed Mar. 30, 2006 is hereby incorporated by reference in its entirety.

FIELD OF THE INVENTION

The present invention relates generally to tracking mobile objects and more particularly to a system and apparatus for continuous monitoring of mobile objects.

BACKGROUND OF THE INVENTION

Mobile object monitoring is rapidly becoming an important and effective way to track mobile objects in a variety of settings. One such setting may be the monitoring of persons convicted of minor offenses, as an alternative to imprisonment. Additional settings where mobile object monitoring may be desired may include the monitoring of children, the elderly, or persons with reduced physical or mental capacity. In all such settings, an individual may be accorded a certain amount of freedom, but may also be constantly monitored to prevent harm to him or others, and ensure that the monitored individual is complying with parameters set forth by a monitoring entity.

Current methods for tracking mobile objects require information to be transferred from a processing center to individual tracking devices. These systems lack mobile tracking device to device communications capabilities. Disadvantageously, a mobile object tracking device must be within satellite or signal transmission range to receive information or be detected by a processing assembly. Further, an out of range mobile tracking device may be unable to contact a processing assembly upon detection of breach of a device component housing or securing mechanism. Similarly, only a processing center may distribute location information based on data transmitted by a GPS receiver located in a portable tracking device and provide an alert for a violation.

Consequently, it is desirable to provide a system and method for continuous monitoring and detection of one or more mobile objects and real-time sharing of information among all system components.

SUMMARY OF THE INVENTION

Accordingly, the present invention is directed toward a system and apparatus for tracking a mobile object providing continuous monitoring and detection of one or more mobile objects including real-time sharing of information among all system components and biometric detection.

In a first aspect of the invention, a system for continuously monitoring a mobile object is considered. System may include assisted GPS for gathering almanac and ephemeris position information. It is further contemplated that a system for continuously monitoring a mobile object may utilize any monitoring and locating system suitable for providing continuous information, including position information, among system components. Assisted GPS may be suitable for transmitting gathered information to a server. System may provide two-way communications between geographically distinct system devices such as between a base assembly, remote server system, tracking assembly and wireless tether assembly. Two-way communications may confirm the presence of a wireless tether among devices. To accomplish two-way communications, one or more geographically distinct system devices may include a transceiver for communicating with one or more additional system devices within range. System may further include providing multiple paths for communicating component information among system devices. System may include a dual frequency transceiver having dual antennas. Dual antennas may provide increased communication reliability, as it may provide listening capabilities on either antenna to detect and confirm signal loss. Additionally, a system utilizing multiple frequencies and multiple antennas may provide multiple in and out paths for communications. System may provide a range determination for system devices. It is further contemplated that multiple antennas may provide improved range determination. System may further include mobile substance detection with biometric verification. Substance detection and biometric verification may be included on a system tracking assembly having GPS monitoring capabilities to allow substance sensing and analysis with mobile object biometric confirmation.

In an additional aspect of the invention, system may include one or more mobile object worn devices suitable for providing a wireless tether among two or more geographically distinct system devices. In one embodiment, wireless tether device may be a wireless tether assembly having tamper detection capabilities. Wireless tether assembly may include a transceiver, and thus, may not be limited to only transmitting capabilities. In one instance, wireless tether assembly may include a tamper resistant strap. A wireless tether assembly strap may pulse optical transmissions between 2 or more optical strips to detect strap tampering. Pulses may be random or fixed time pulses and may be adjustable. Pulse could be used on one or more channels specifically reserved for optical transmission. Wireless tether assembly strap may further include method for partitioning the strap as it is placed on a mobile object. This may be advantageous, for instance, by reducing the amount of time required to install the cuff. Prior art wireless tether straps often require an object measurement prior to securing of the wireless tether assembly on a mobile object. A wireless tether assembly strap in accordance with the present invention may provide strap sizing, strap cutting and strap securing as the strap is placed on a mobile object.

In a further additional aspect, a method for reviewing mobile object movement information is considered. Method may utilize software or firmware processes to review information. Method may include predictive algorithms to identify mobile object pattern deviations. Method may further include a compression algorithm for reducing memory requirements in a system. For example, it is contemplated that a portable tracking assembly may transmit information to a central server. Compression algorithm may reduce storage requirements upon transfer of information to the central server by compressing data.

It is to be understood that both the foregoing general description and the following detailed description are exemplary and explanatory only and are not restrictive of the invention. The accompanying drawings, which are incorporated in and constitute a part of the specification, illustrate an embodiment of the invention and together with the general description, serve to explain the principles of the invention.

BRIEF DESCRIPTION OF THE DRAWINGS

The numerous objects and advantages of the present invention may be better understood by those skilled in the art by reference to the accompanying figures in which.

It is to be understood that both the foregoing general description and the following detailed description are exemplary and explanatory only and are not restrictive of the invention.

DETAILED DESCRIPTION OF THE INVENTION

Reference will now be made in detail to presently preferred embodiments of the invention, examples of which are illustrated in the accompanying drawings.

Figure 1:
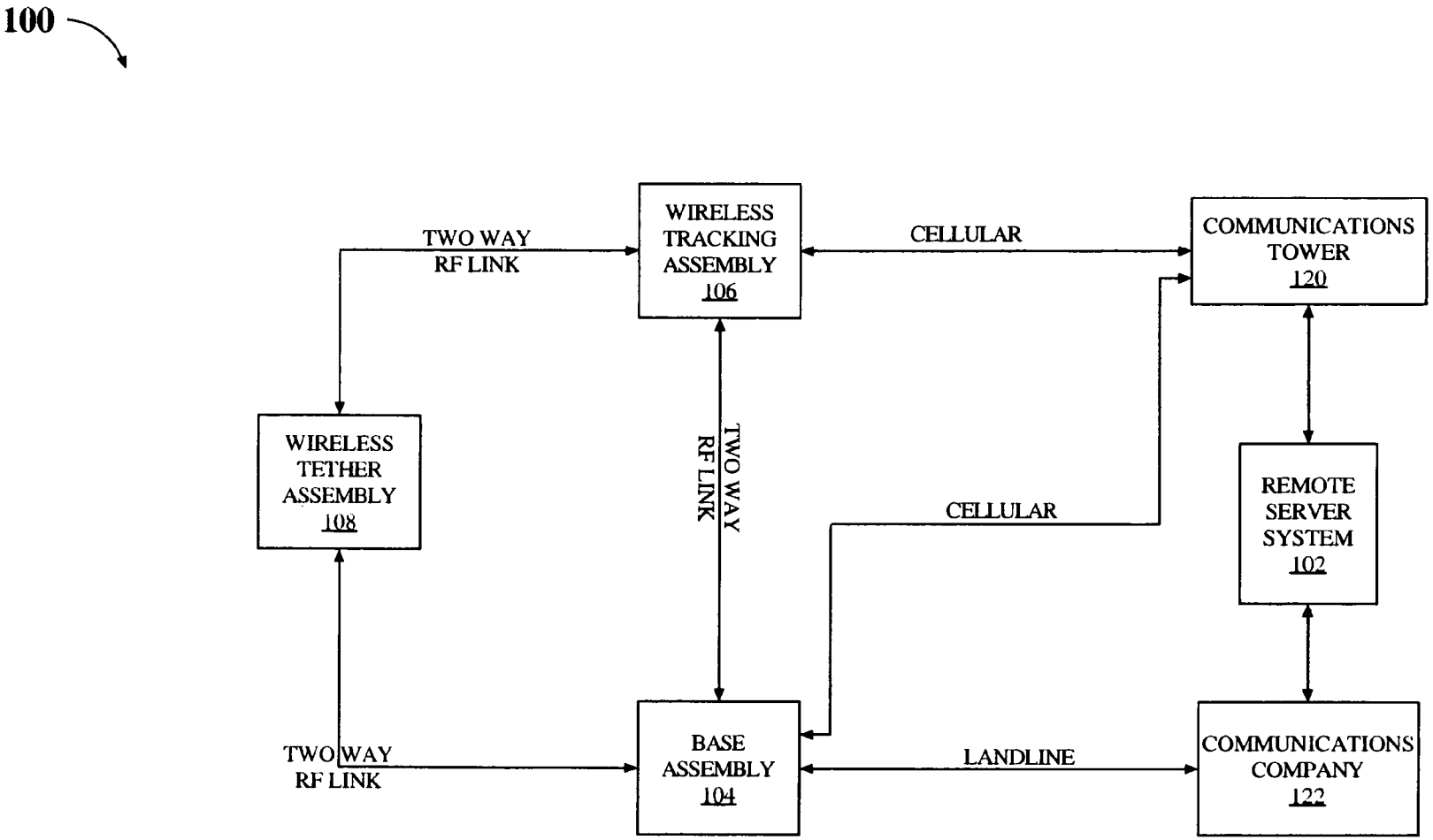
FIG. 1 is a block diagram representing a system for continuously monitoring a mobile object in accordance with an exemplary embodiment of the present invention.

Referring generally to FIG. 1, a system 100 for continuous mobile object monitoring in accordance with an exemplary embodiment of the present invention is shown. System 100 may be comprised of one or more individual geographically distinct system devices communicatively coupled to receive and transmit information among all system devices. In one embodiment of the present invention, system may include a remote server system 102 such as a centralized server, a base assembly 104, a tracking assembly 106 and a wireless tether assembly 108 communicatively coupled to provide continuous mobile object position information. System may further comprise a communications tower 120 and a communications company 122, both suitable for communication with the remote server system. In one embodiment, base assembly 104, wireless tracking assembly 106 and wireless tether assembly may communicate via a two way radio frequency (RF) communications link. Further, wireless tracking assembly 106 and base assembly 104 may also communicate with a communications tower 120 via a cellular communications link. Base assembly may communicate with a communications company 122 via a landline, as shown, or via a cellular communications link. It is contemplated that the various components of the system 100 may communicate with each other via any communication method suitable for communication across relatively short or relatively longer distances, including any radio frequency communications methods, any cellular communications methods, and any landline communications methods.

Remote server system 102 may be suitable for receiving monitoring information from a plurality of mobile objects and may be substantially comprised of a computer processor and a communications controller. Base assembly 104 may be a fixed location assembly and may receive and transmit information to and from remote server system, wireless tether assembly and tracking assembly 106. Wireless tether assembly 108 may provide unique mobile object identification information and may communicate identification information to a tracking assembly 106. In an alternative embodiment, tracking assembly 106 and wireless tether assembly 108 may be integrated. Tracking assembly 106 may receive and store data, and may be suitable for reporting violations such as AC loss, phone loss, battery back up, tracking assembly housing tamper, absence or presence of RF signal, loss of GPS, wireless tether assembly tamper detection, wireless tether assembly low battery detection, and the like. One or more system monitoring devices may include a GPS receiver suitable for receiving GPS position information. GPS receiver may further include an atomic clock for precise timestamping of location information. One or more system devices may include multiple GPS antennas for increased reception of GPS signals. System 100 may provide victim notification and may be further comprised of a victim wearable device. In an additional embodiment, system may also include an additional fixed location assembly that may detect the presence of an absconding mobile object within an unauthorized radius of the fixed location assembly. It is further contemplated that system 100 for continuously monitoring a mobile object of the present invention may utilize any monitoring and locating system suitable for providing continuous information, including position information, among system components.

One or more system devices may be comprised of a monitoring component such as a GPS receiver or transceiver and a communication component such as a wireless communication device. The system 100 may utilize a Global Positioning System (GPS), an assisted GPS (A-GPS) including a combination of cellular communications and GPS, or a like location determining system, as well as two-way transceiving to allow communication among all devices in a system and provide continuous accurate monitoring of a mobile object. GPS may refer to a global positioning system that utilizes an assistance server to reduce location detection time. A typical GPS receiver may require a clear line-of-sight to at least four GPS satellites before performing a position calculation. In addition, a GPS receiver may require substantial processing power to transform a data stream from one or more satellite into a position. In a system utilizing A-GPS, a cellular network tower may receive a signal from one or more satellites, and perform the calculations. A device having a cellular modem may relay any GPS signal it receives to the tower for position calculation.

In an A-GPS network, a receiver may be limited in processing power and under unfavorable conditions for position fixing. However, an A-GPS receiver may communicate with the assistance server having high processing power and access to a reference network. For example, an A-GPS network may be a cellular network and an assistance server may communicate with a GPS receiver via a cellular modem on the network. The A-GPS receiver and the assistance server may share tasks, allowing a more rapid and efficient process of locating a mobile object. Additionally, an assistance server may access information from the reference network and provide greater computing power than a typical GPS receiver.

It is contemplated that mobile object monitoring system may be implemented with GPS, differential GPS, kinematic differential GPS, real time kinematic differential GPS, or a like global positioning system having enhanced error correction to provide differential, real-time, post processing or like GPS correction. It is further contemplated that mobile object monitoring system may include one or more methods for detecting and monitoring the location of a mobile object, including triangulation utilizing wi-fi hotspots, television transmission signals and the like.

System 100 may include enhanced mobile object monitoring device satellite detection. For instance, a system device may gather satellite data from one or more satellites within the GPS system. In one embodiment, a tracking assembly 106 capable of detecting a GPS system may gather satellite information and transmit information to a system server. Satellite information may include satellite almanac and ephemeris data. Almanac data may refer to information regarding GPS satellite location at a particular moment in time. An individual satellite may transmit almanac data regarding orbital information for the satellite, as well as and for every other satellite in the system. Orbital position almanac data may be relatively imprecise; however, ephemeris data may provide a correction for almanac data. Ephemeris data may refer to precise orbital position and clock data for an individual GPS satellite. Ephemeris data may be constantly transmitted by an individual satellite within a GPS system and may contain information regarding a satellite, such as status of the satellite, i.e., healthy or unhealthy, current date, time and the like. Such ephemeris data may be valid for approximately 30 minutes. Additionally, a GPS receiver may read satellite information and save the ephemeris and almanac data for continual use. This information may also be utilized to set or correct a clock within the GPS receiver.

Information gathered by a tracking assembly 106 may be transmitted to a remote server system at a previously scheduled interval or upon request from a monitoring user. It is contemplated that a system server or remote server system 102 may transmit information to a tracking assembly 106 to obtain a more precise location determination. Ephemeris, almanac and other such position, location biometric and like data may be transmitted to one or more mobile object monitoring devices that may not be within detection range of a satellite. In this manner, a blind monitoring device may provide increased ability to detect a satellite or rapid reacquisition upon satellite detection. Advantageously, system may allow communication between a device receiving a signal and a device that may be out of range to receive a signal, but within range of the signal receiving device. For example, a first tracking assembly 106 may transmit information through a second tracking assembly if the first is unable to communicate with a base or remote server system. Information may be transmitted in response to a request from a system device located in a specific geographic area. In one embodiment, a system device such as a tracking assembly 106 may exchange current ephemeris and almanac information with another tracking assembly that may not have otherwise received the information.

Figure 2:
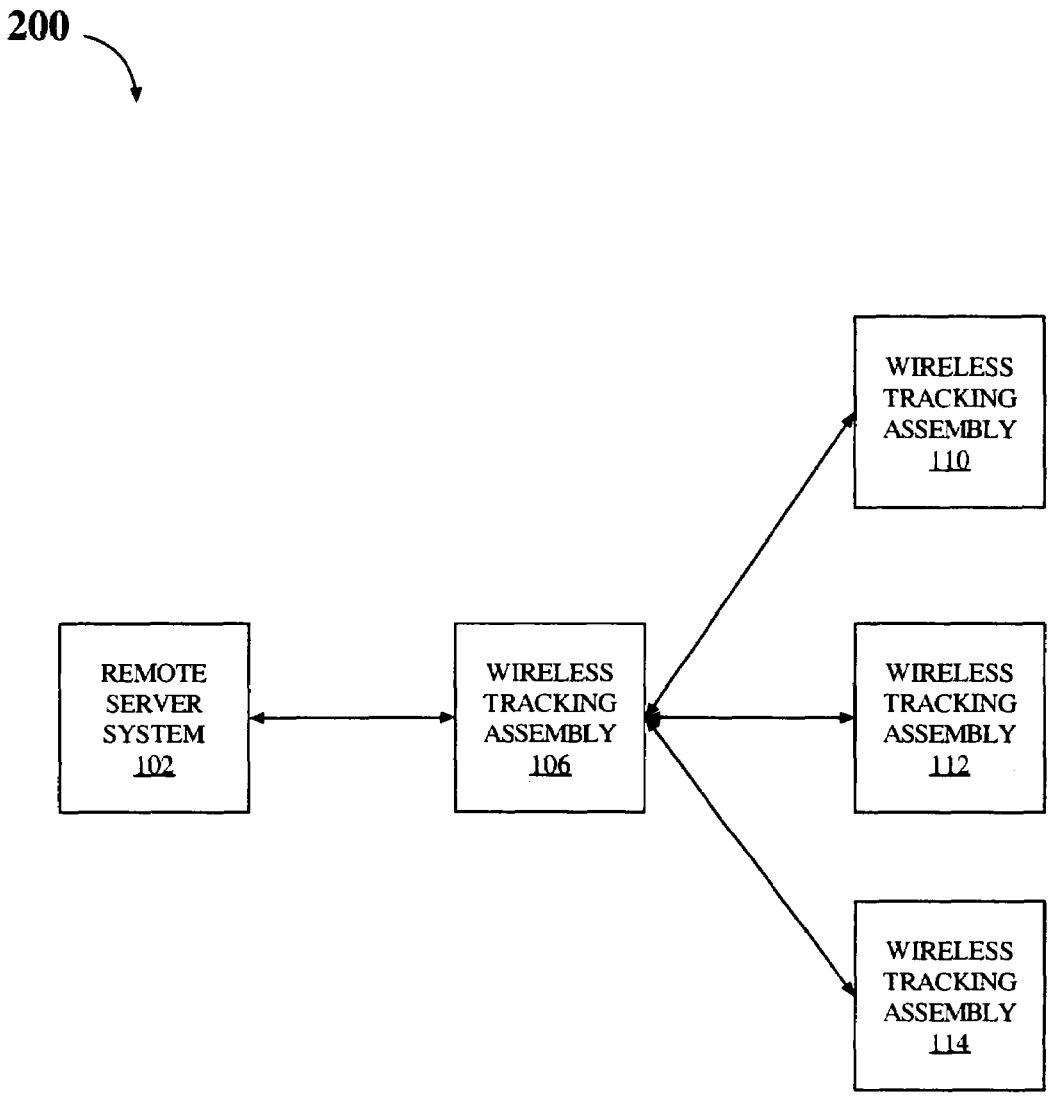
FIG. 2 is a block diagram of an example of mobile object information forwarding in accordance with an embodiment of the present invention.

Referring to FIG. 2, a block diagram 200 of example of mobile object information forwarding in accordance with an embodiment of the present invention is shown. A remote server system 102 may transmit information to a tracking assembly 106. Tracking assembly 106 may then transmit mobile object information to one or more tracking assemblies 110-114 that may not be within range of the remote server system 102. In addition to accurate position determining, system 100 may continuously determine speed and direction of an in-motion mobile object in real-time and forward this data through any tracking assembly 106 within range of the remote server system 102. This may be advantageous in the instance of a "fleeing" mobile object.

In an additional embodiment, base assembly 104 may receive ephemeris, almanac and other such position, location biometric and like mobile object data from a remote server system 102 and retransmit the data to an out-of-range tracking assembly 106 or wireless tether assembly 108.

Information may be transmitted between two or more system devices via a radio frequency (RF) link or an infrared (IR) link. In one embodiment, RF link may be a digital radio frequency link such as a spread spectrum radio frequency link. However, it is contemplated that a system in accordance with the present invention may employ alternative spread spectrum modulation such as frequency hopping, time hopping, chirping or like spread spectrum modulation, including any hybrid or combination of any variety of spread spectrum modulation, orthogonal frequency division multiplexing, or the like suitable for transmitting information such as location, biometric, and like data among system devices. IR link may provide continuous listening capabilities, which may be important to prevent tracking assembly housing tampering.

The wireless tether assembly 108, tracking assembly 106 and base assembly 104 may include a transceiver suitable for providing two-way communications between geographically distinct system components. This may provide confirmation that a wireless tether is present between multiple devices in the system. A transceiver in range may communicate with another in range transceiver for location confirmation. For instance, base assembly 104 may notify a user that tracking assembly 106 is in range and needs to be docked. Additionally, tracking assembly 106 may notify user that base assembly 104 is in range and tracking assembly 106 needs to be docked. Further, wireless tether assembly 108 may notify user that the wireless tether assembly 108 is not within range of base assembly 104 or tracking assembly 106 by providing an alert such as a vibration, audible alert and the like. To accomplish system device communications among all system devices, system 100 may also include multiple paths for communicating system device information. System may utilize multiple wireless interfaces simultaneously, as may be required by multipath communication. System may run multiple Transmission Control Protocol (TCP) connections, i.e., one or more per wireless interface between remote server system and base assembly, tracking assembly 106 and wireless tether assembly. This may allow for accurate packet reordering across the multiple communication paths, ensuring accurate communication of information among system devices.

System 100 may provide range determination for system devices. In one embodiment, range determination may be a multiple frequency range determination, such as a dual frequency range determination. It may be desirable to determine a range between two or more geographically isolated system components to ensure that devices are operative and in communication. For instance, two or more geographically distinct system devices, such as a wireless tether assembly and tracking assembly 106 may have a maximum allowable separation distance. Separation distance may be determined by system operator in accordance with a mandate from a law enforcement official, a value determined by a parent or guardian, and the like. System 100 may receive maximum separation distance input and monitor range between relevant components. For instance, system may utilize received signal strength indication (RSSI) to determine a range between a body worn mobile tracking device and a base assembly or portable tracking assembly 106. RSSI may refer to a measurement of received signal strength in a wireless environment. RSSI may be utilized internally in a wireless networking card located in one or more system devices to determine when a signal falls below a certain threshold, providing a point at which the network card may be clear to send (CTS). Once a card is clear to send, a packet of information may be transmitted. RSSI measurements may vary from 0 to 255 and may be comprised of a one byte integer value. For example, a value of 1 may indicate the minimum signal strength detectable by a wireless card, while 0 may indicate no signal. An RSSI range of values may include a maximum value, RSSI_Max. For example, a card in accordance with the present invention may return a RSSI of 0 to 100. Therefore, in this instance, the RSSI_Max may be 100. A card may report 101 distinct power levels. A determined range may be compared against a user set value as a maximum range devices may be separated. RSSI may be determined in the IF stage before the IF amplifier. In a system having zero-IF, RSSI may be determined in the baseband signal chain, before the baseband amplifier. RSSI output may be a DC analog level. It may also be sampled by an internal ADC, with resulting codes available directly or via peripheral or internal processor bus. If system determines that a maximum separation distance has been exceeded, a system device such as a tracking assembly 106 or base assembly may alert mobile object, as well as the monitoring user. It is further contemplated that multiple antennas may provide improved range determination.

System 100 may provide signal strength information to a wireless tether assembly to reduce power usage due to reduced power requirements. For example, a base assembly 102 or tracking assembly 106 may communicate a request to wireless tether assembly to transmit at reduced power for a period of time due to increased or optimal signal strength reading. Base assembly 102 may also communicate reduce power transmission request to tracking assembly 106. Additionally, base assembly 102 may communicate a request to an integrated tracking-wireless tether assembly to transmit at reduced power for a period of time due to increased or optimal signal strength reading. In this manner, wireless tether assembly 108, tracking assembly 106 or wireless tether-tracking assembly battery may be conserved. One instance where lower transmission power may be desirable may be when a wireless tether assembly 108 and tracking assembly 106 are proximally located, such as when a wireless tether assembly 108 and tracking assembly 106 are secured to a mobile object. Transmission distance to and from tracking assembly 106 may be minimal, substantially reducing transmission power necessary for communication between a wireless tether assembly and a tracking assembly 106. For an embodiment of the invention having an integrated wireless tether and tracking assembly 106, base assembly may transmit signal strength indication to wireless tether-tracking assembly. Wireless tether-tracking assembly may reduce transmission power when located near a base assembly, or when signal strength is increased and therefore requiring less transmission power.

System 100 may utilize multiple communication paths for transmitting and receiving information regarding a mobile object. For instance, system 100 may utilize dual frequency transmission. Dual frequency transmission may further include dual antennas for picking up one or more signals transmitted on one or more frequencies. Multiple frequency transmission may provide increased communication reliability, as it may provide listening capabilities on any of a plurality of antennas integrated with the system to detect and confirm signal loss. It is further contemplated that a system utilizing multiple frequencies and multiple antennas may provide multiple in and out paths for communications and enhanced range determination. For example, a system having dual frequency transmission and dual antennas may allow for four communication paths in and four communication paths out. System 100 may provide antenna reception detection and may determine which one or more of multiple antennas may provide greatest reception. Multiple frequency transmission may assist in determining if a mobile object has migrated beyond the range of a base assembly, tracking assembly 106, control station or the like. In one embodiment, a signal may be received by at least one of a plurality of base assembly antennas, tracking assembly antennas, antennas located at the remote server system, or at any desired location. One or more antennas may be designated to receive a signal from a device in the system. If a designated antenna does not receive a transmitted signal, a system device may designate an alternative antenna, alternative frequency for transmission, or both. Transmission from a receiving device may also be accomplished via multiple frequencies and may communicate to a transmitting device that a signal has not been received and request a re-transmission or provide alternative confirmation that a wireless tether assembly is in range. For instance, if a wireless tether assembly 108 may be unable to receive a transmitted signal from an intended receiving device, the wireless tether assembly 108 may provide a vibration alert, an audible alert, or the like to instruct a mobile object to return to range.

System 100 may be suitable for active or passive monitoring of a mobile object. For instance, a system device may include one or more active RF tags, one or more passive RF tags, one or more semi-active tags, and the like. An active RF tag may include an on-board battery and may provide the longest communication range, the capability to perform monitoring and control, initiate communications, and perform diagnostics. An active RF tag may also include the highest data bandwidth. A semi-active tag may be smaller than an active tag and may have less power. A system having active RF tags may include a cellular modem for scheduled location reporting, unscheduled location reporting, violation reporting, and the like. For instance, an active tracking assembly 106 may report the location of a mobile object every 4 hours, but may also report a violation immediately upon occurrence.

In an alternative embodiment, system 100 may be a passive monitoring system employing passive RF tags. Passive systems generally require line-of-sight interrogation of powerless, inexpensive, low-capacity transponder devices. A passive radio frequency tag may be a small device utilized for short-range, simple tracking and monitoring applications. Advantageously, a passive RF tag device may be relatively inexpensive and long lasting. A passive tag may not include an on-board battery and may only provide short communication ranges (1-5 meters) with no capability to perform monitoring or control. A passive tag may be powered by radio waves suitable for reading a passive tag. A passive RF tag may include a low data bandwidth, and may not be suitable for initiating communications, they must be read. However, a passive tag may store limited information.

A passive tag in a system of the present invention may utilize a reader as a source of energy for a chip and for communication from and to an RFID reader. The available power from the reader field may be reduced rapidly with distance, resulting in a limited communication distance. A typical reading distance may be 0-5 (meters) for (123 KHz), 0-80 cm (centimeters) for (13-56 MHz), 0-5 m for (860 MHz-930 MHz) and the like. Benefits of passive tags include getting information from many tags simultaneously, read and write capability, tracking items in crowded places, and locating missing items.

In a further additional aspect, system 100 may include a tracking assembly 106 or wireless tether assembly 108 having controlled substance and alcohol detection, and biometric verification capabilities to detect the presence of substances such as alcohol or narcotics and provide biometric confirmation of mobile object identity. Tracking assembly 106, wireless tether assembly 108, combination tracking-transmitting assembly, or any other device in the system may include an alcohol and substance detection device, a camera and a position location device. In this manner, location based rules and alcohol rules may be created for a mobile object. For instance, a mobile object may be away from a base assembly and may test positive for alcohol. An alert may be transmitted to an authority providing notification of a potentially intoxicated mobile object. Additionally, a mobile object vehicle may be disabled. However, if a mobile object is detected in an area where alcohol may be present but is not a desired exclusion zone, such as a mall, system substance detector may generate an unscheduled substance test on-site to confirm compliance with applicable rules. This may allow a monitoring entity to request a mobile object to immediately submit to alcohol or controlled substance detection at any location. Alcohol sensor may include breath analysis, blood analysis, DNA analysis, transdermal alcohol detection such as secure continuous remote alcohol monitoring (SCRAM), or like capabilities suitable for detecting the presence or absence of alcohol in a mobile object's blood stream, as well as the specific level of alcohol present. Sensor may compare a detected level against an input threshold level to determine if a violation has occurred. Controlled substance sensor may similarly include blood analysis, urine analysis, DNA analysis or like substance detection capabilities suitable for detecting the presence or absence of a controlled substance in a mobile object's blood stream. Sensor may compare a detected chemical composition against an input known substance composition to determine if a violation has occurred. If a violation has occurred, a remote server system may be notified and remote server system may alert a third party for resolution of a violation situation and containment of the mobile object if necessary.

Tracking assembly 106 further may include biometric confirmation such as photographic, video, or like capabilities to capture one or more images of a mobile object as a mobile object is performing or subjected to substance detection. Visual identification may prevent a mobile object from attempting to substitute another party when alcohol or substance detection is requested. Tracking assembly 106 may then transfer mobile object image to a remote server system for mobile object identity verification. It is further contemplated that mobile object identification may include DNA verification if substance detection is performed via DNA analysis. DNA testing may be on-site analysis or DNA information may be scanned and transmitted to an off-site facility for analysis and may include any method suitable for analyzing DNA information such as spectral analysis and the like.

System may detect shielding and provide alert notice upon shielding detection. It is contemplated that a mobile object may attempt to prevent signal detection of a tracking assembly 106 or wireless tether assembly 108 by shielding a signal. It is contemplated that a mobile object may attempt to block, diffuse or redirect signals away from a tracking assembly. However, shielding may be perceived as a null, or a naturally occurring "dead spot" and not as an attempt to block a transmitting signal. A system device may determine if one or more other system devices is being shielded by detecting a signal reflection having a measurable amount of associated energy that would not be present in a transmission null. In this manner, an appropriate authority may be notified of attempted shielding immediately upon shielding detection. System may also provide jamming prevention to detect any deliberate interference intended to prevent reception of signals. Jamming prevention may be accomplished by an anti-jamming device which may be located inside a tracking assembly or base assembly. A predictive algorithm may be utilized to determine if shielding or jamming is attempted. Additionally, multiple transmission paths may be utilized. In one embodiment, a transmission may be generated from a tracking assembly, wireless tether or other mobile system device. A signal from the device may be detected and signal strength may be determined. If signal strength exceeds a programmable threshold, a shielding violation may be generated. In an alternative embodiment, a signal transmitted from a mobile device may travel a distance away from the mobile device, bounce off a surface and return. Distance to the object may be calculated, and if the distance is less than a programmable distance, i.e., a relatively short distance, a shielding violation may have occurred, and a shielding violation notification may be generated.

It is further contemplated that a system in accordance with the present invention may include a web based monitoring subsystem, allowing a monitoring entity to access information regarding a monitored object via a network such as the internet. A task file may be created when a system device is assigned to a mobile object. Task file may include mobile object location boundaries, violation parameters, mandatory reporting schedule information, and the like. Web based subsystem may include one or more algorithms suitable for calculating and providing environmental, positional and sensory information regarding a monitored object. These algorithms may include one or more predictive algorithms utilized to identify mobile object behavior patterns. Predictive algorithm may include comparing current location and movement to a database of historical location and movement patterns for a mobile object. Predictive algorithm may also include correlation of current location with a known geographic location to determine whether a mobile object may be violating an established parameter. Any predictive algorithm suitable for comparing current behavior with previously stored data may be utilized to determine compliance or non-compliance with established parameters.

In an additional embodiment of the present invention, system 100 may further include a detector assembly suitable for detecting one or more tracking assemblies. Detector assembly may be a stationary assembly for detecting the presence of one or more mobile objects within an area. For example, detector assembly may be located at a school, and may detect the approach or presence of an unauthorized mobile object such as a sexual offender prohibited from coming within a pre-determined radius of the school. Detector assembly may alert a remote server system of an offender violation for notification of an authority.

Figure 3:
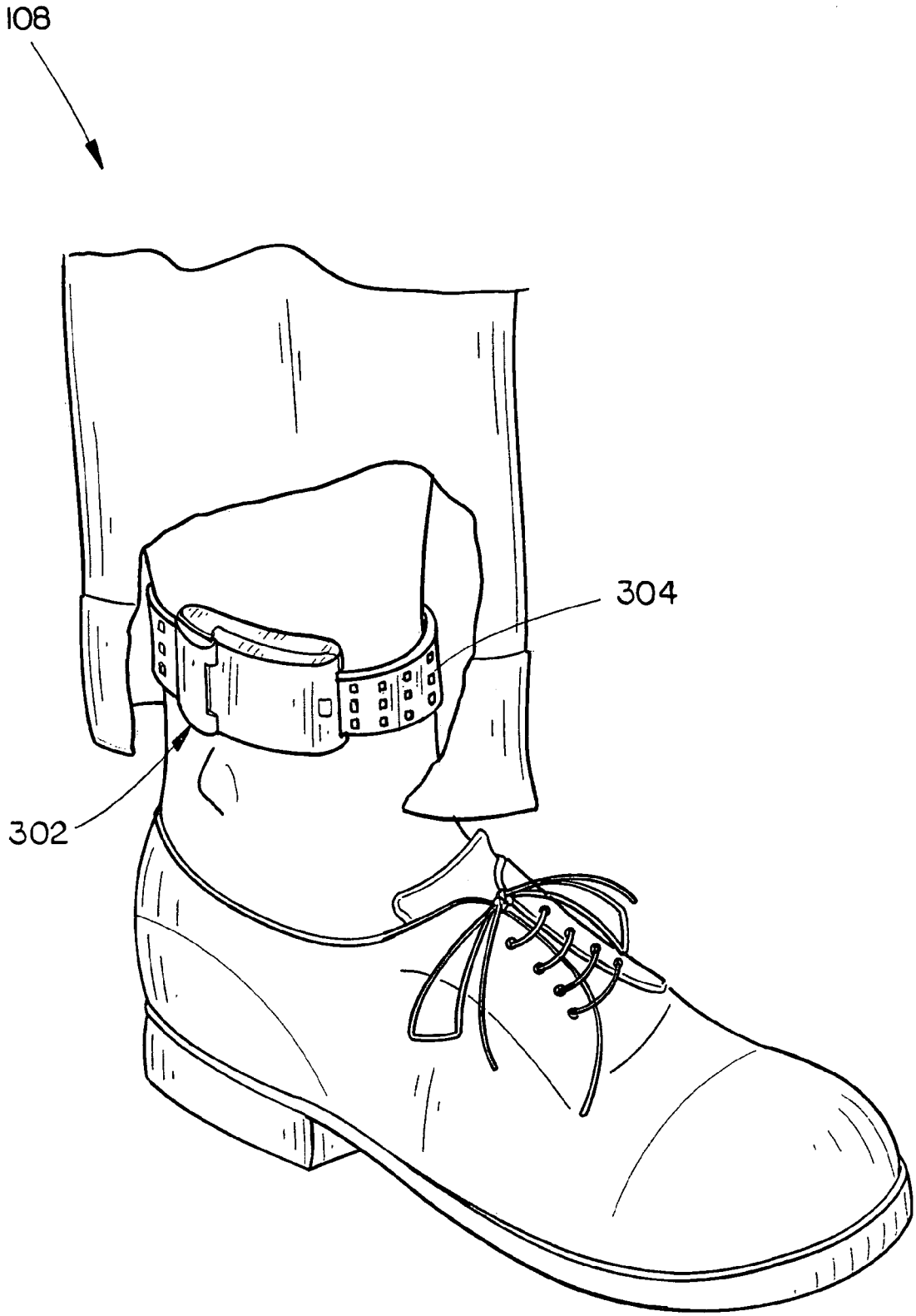
FIG. 3 depicts a system wireless tether assembly implemented with a mobile object in accordance with an exemplary embodiment of the present invention.
Figure 4:
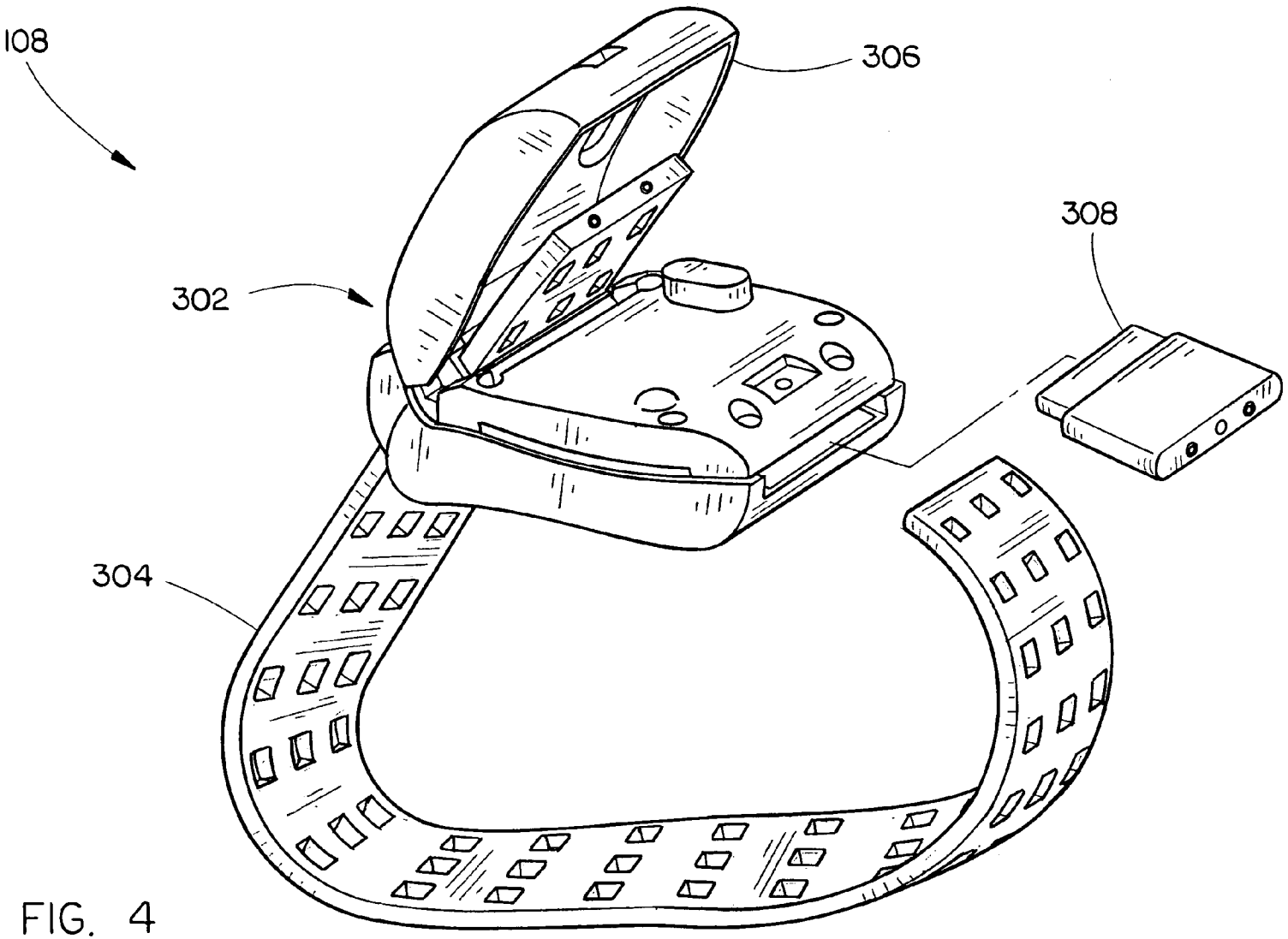
FIG. 4 is an isometric view of a wireless tether assembly in accordance with an exemplary embodiment of the present invention.
Figure 5:
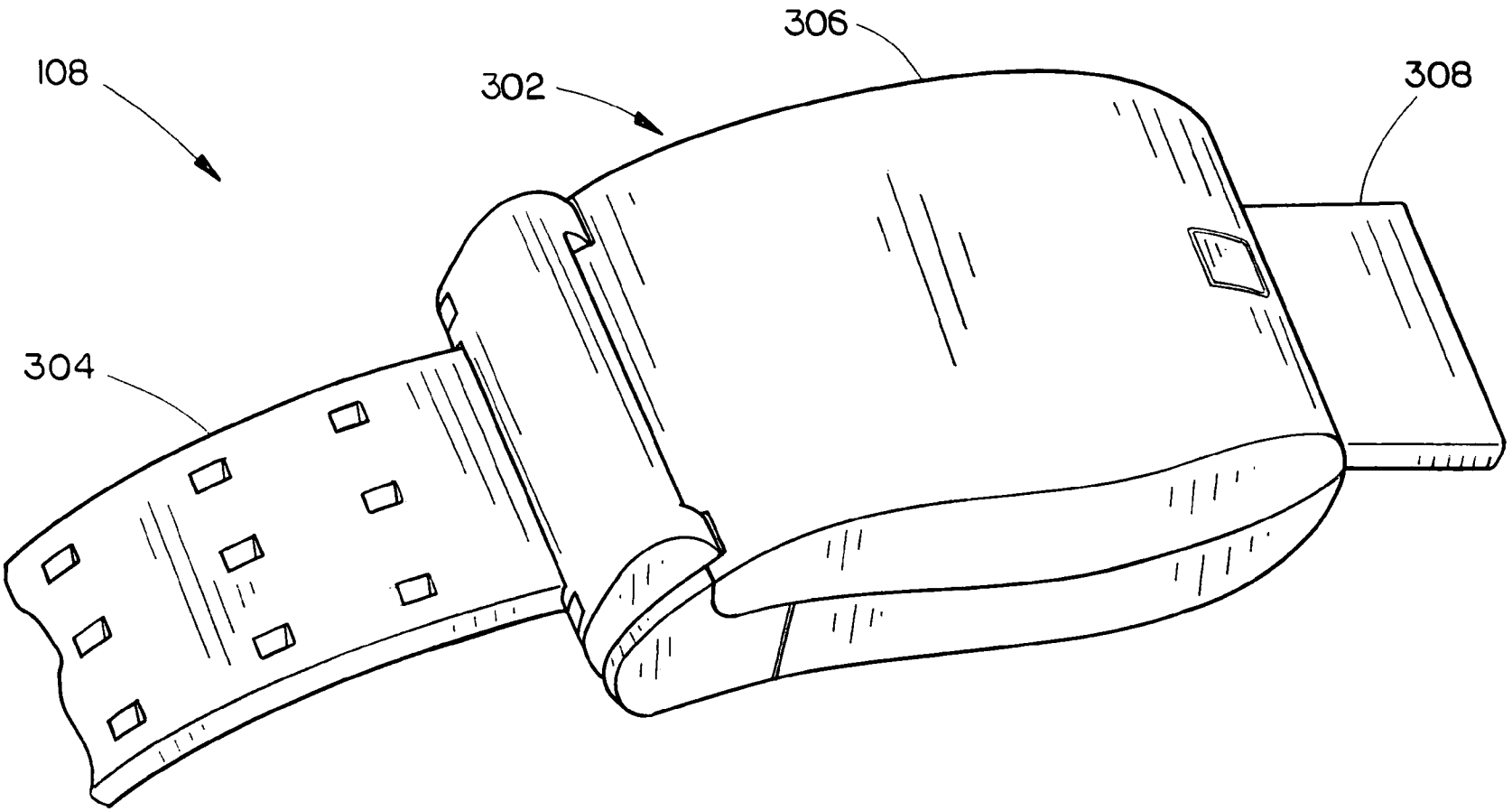
FIG. 5 is an exploded view of a wireless tether assembly in accordance with an embodiment of the present invention.
Figure 6:
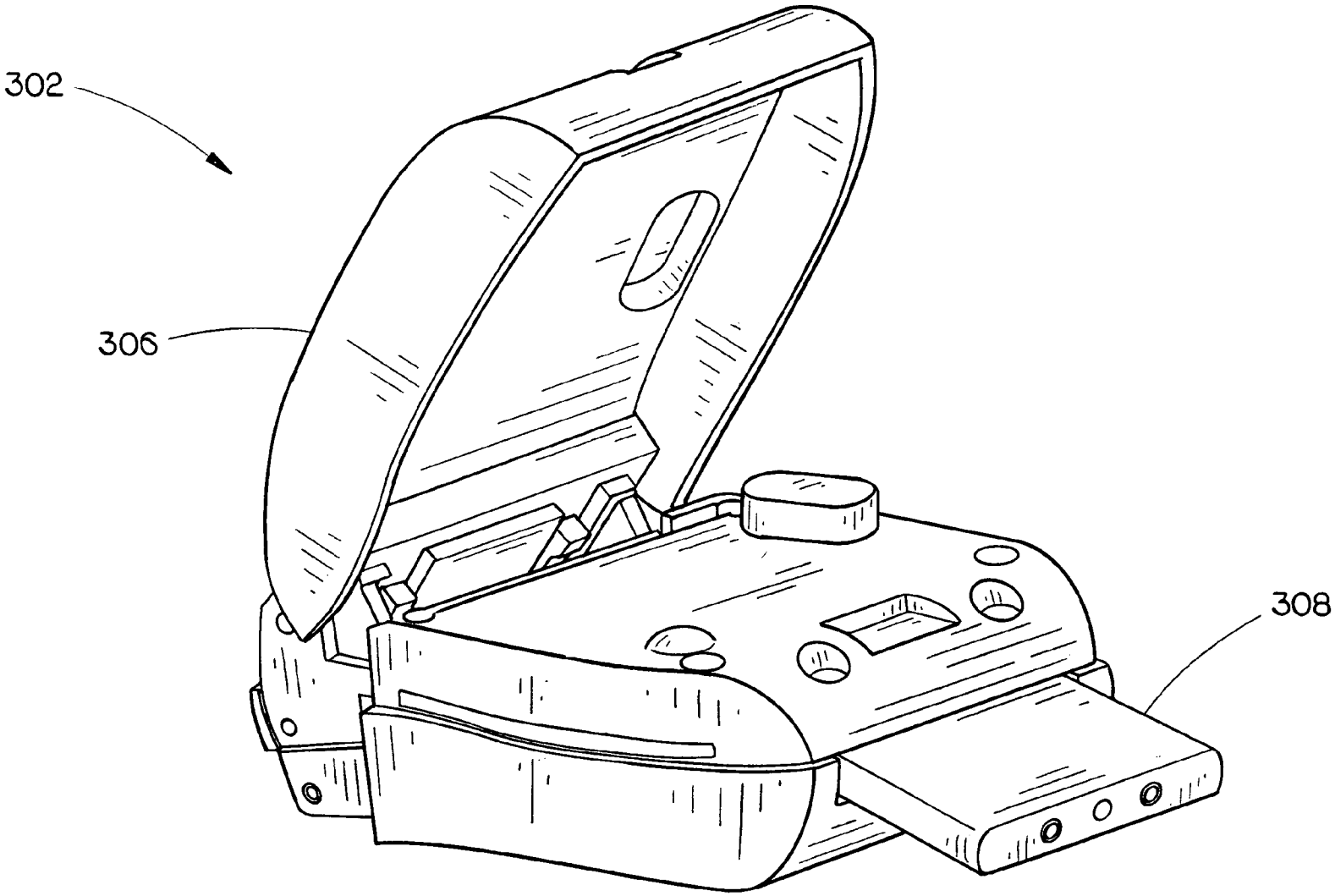
FIG. 6 is an isometric view of a transceiver assembly in an open position in accordance with an embodiment of the present invention.
Figure 7:
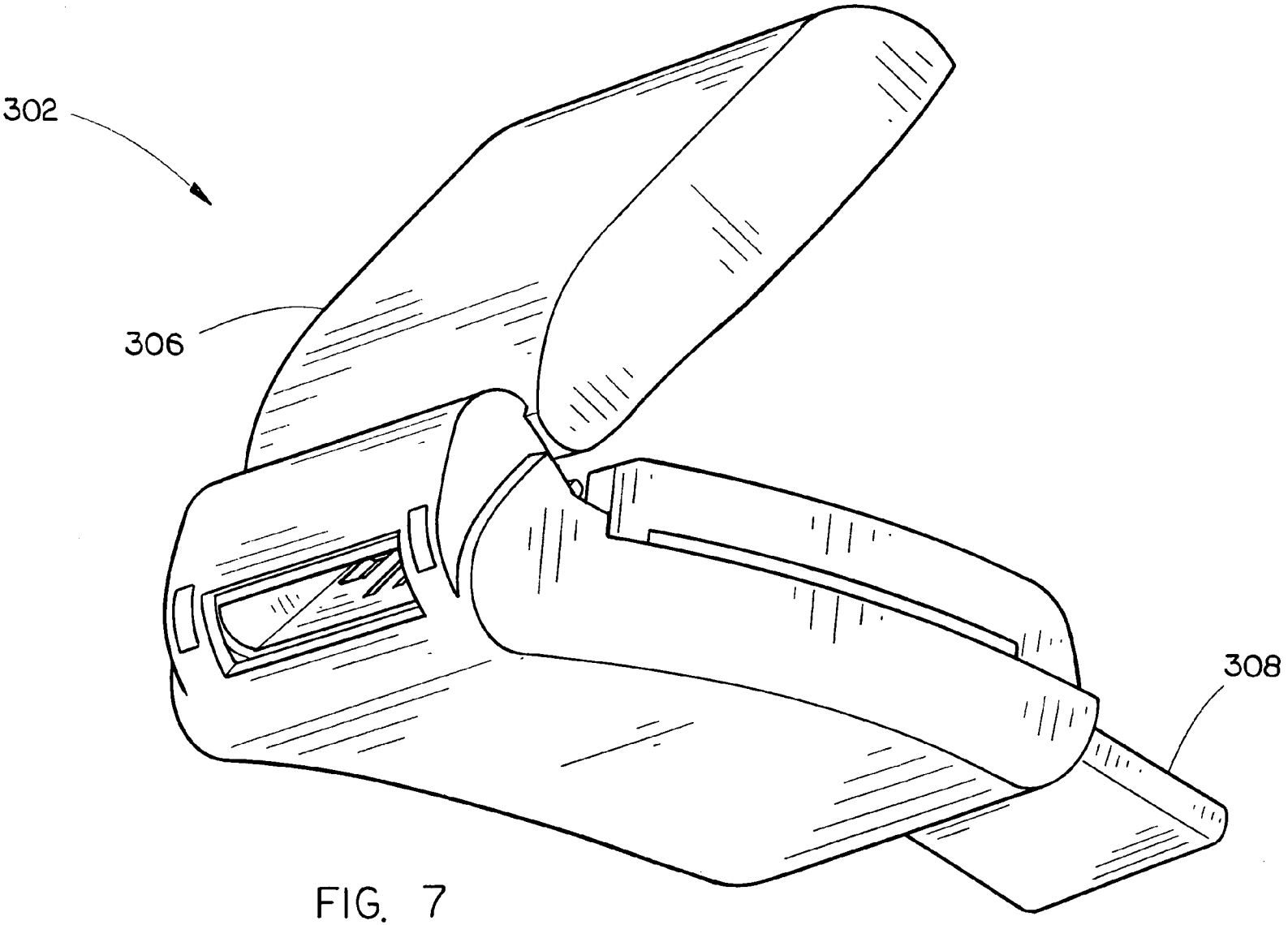
FIG. 7 is a back isometric view of a transceiver assembly in an open position.

Referring generally to FIGS. 3-11, a wireless tether assembly 108 in accordance with an embodiment of the present invention is shown. Referring specifically to FIG. 3, wireless tether assembly 108 implemented with a mobile object in accordance with an exemplary embodiment of the present invention is shown. It is contemplated that wireless tether assembly 108 may be secured to a mobile object. example, for a living mobile object, wireless tether may be worn on the wrist, ankle, or the like, and tracking assembly may be worn around the waist. For non-living mobile objects, a wireless tether and/or tracking assembly may be placed inside object housing or secured around a portion of a mobile object such as a handle or through a dual slot opening. It is further contemplated that wireless tether assembly 108 and tracking assembly 106 may be integrated. For example, all aspects of a system wireless tether assembly 108 may be integrated into a tracking assembly 106 and may provide identification information, tamper detection, position information and the like.

With continued reference to FIGS. 3-11, wireless tether assembly 108 may be comprised of a strap 304 suitable for engaging with a portion of a mobile object, and a transceiving assembly 302 suitable for two-way communication with one or more system devices such as a tracking assembly 106, a base assembly 104 and a remote server system 102. Wireless tether assembly may also comprise several novel features for receiving signals, resisting tampering and sizing wireless tether strap 304. In one embodiment, wireless tether assembly 108 components may be arranged in a tamper resistant housing 306 having tamper detection capabilities. Wireless tether assembly 108 components may include a vibrator motor, a wireless communication device 308, a power supply and any additional required electrical components. Wireless tether assembly 108 may include a motion detector. Motion detector may utilize an accelerometer, a thermal, piezoelectric, gyroscopic, micro electrical mechanical or a like device suitable for detecting motion. Motion detector may be suitable for detecting misuse. For example, motion detector may detect device impact. Additionally, motion detector may be suitable for providing dead reckoning. Motion detector may further include an inclinometer suitable for determining a degree of tilt with respect to gravity. In one embodiment, wireless tether assembly strap 304 may include an antenna. Wireless tether assembly strap 304 may further include a zip tie mechanism for securing the strap 304 about a portion of mobile object. Wireless tether assembly strap 304 may also include a locking mechanism to provide a secure wireless tether assembly strap bond around a portion of a mobile object. Locking mechanism may be comprised of a plurality of pins suitable for insertion through existing strap apertures, and a plurality of pins suitable for piercing strap material for partial insertion through strap 304. Wireless tether assembly 108 may further include one or more optical alignment features for a carrier, receptors, generators and the like.

It is contemplated that a wireless tether assembly 108, tracking assembly, or wireless tether-tracking assembly may include optical tamper detection. In one embodiment, wireless tether assembly 108 may include one or more light guides suitable for transmitting information as light pulses. In one embodiment, light guide may be an optical fiber or strip embedded within the wireless tether assembly strap 304, providing multiple optical transmission pulsing. Optical strip may be comprised of one or more of single mode, multimode, plastic optical fiber, or a like material. System device may initiate optical transmission pulsing between 2 or more optical strips. Pulses may be random or fixed time pulses and may be determined by software. Pulse transmissions may be simultaneous on multiple optical fibers, may be transmitted only on one of multiple embedded optical fibers, or may alternate transmission on two or more optical fibers. Optical transmission pulsing pattern may be determined by monitoring entity, and may be likewise be adjusted to alternate pulsing or pulse continuously for any time duration. Wireless tether assembly 108 pulse detector may further detect the constant absence of light or the constant presence of light, as an indicator of attempted wireless tether strap tampering. Wireless tether assembly 108 may transmit detection of strap tampering to base assembly, which may in turn transmit detection notification to a remote server system.

Wireless tether assembly 108, tracking assembly 106, or wireless tether-tracking assembly may include a strap 304 having self-partitioning capabilities. In one embodiment, a wireless tether assembly 108 may include a novel strap 304 and method for partitioning the strap 304 as it is placed on a mobile object. To accomplish strap partitioning, strap 304 may be further comprised of a partitioning assembly suitable for partitioning the strap 304. Strap partitioning assembly may be further comprised of a partitioning element for partitioning the strap 304 and an actuating assembly suitable for actuating the partitioning element with sufficient force to partition the strap 304. This may be advantageous, for instance, by reducing the amount of time required to secure a wireless tether assembly 108 on a mobile object. Disadvantageously, prior art wireless tethers typically require an object measurement prior to installation. A system in accordance with the present invention may provide wireless tether strap sizing, strap partitioning and strap securing without pre-measurement as a wireless tether assembly 108 is placed on a mobile object.

In one embodiment, wireless tether assembly 108 may include a cam and lever mechanism suitable for initiating cutting blade motion for partitioning a wireless tether assembly strap 304. In this embodiment, a spring anchored to a fixed point may support a rolling cam follower against the cam as it rotates. Upward lever motion may be supplied by the cam as it rotates through one or more rise or positive segments. Positive motion may be utilized to move away from an interfering tool path such as a cutting blade. Downward motion may be supplied by the spring as the cam rotates through one or more fall segments. A sharpened edge such as a cutting blade may be located inside wireless tether assembly component housing 306. Cutting blade motion may be generated by lever motion and may be suitable for cutting through strap material. In an alternative embodiment, cutting blade may not be integrated with wireless tether assembly 108. Wireless tether assembly 108 may include a slot through which a blade may be inserted by wireless tether assembly securing authority. Blade slot may provide responsive coupling of the blade with a cutting mechanism such as a cam-lever mechanism, allowing a blade to partition a wireless tether assembly strap 304. Upon completion of strap partitioning, blade may be removed by securing authority.

Alternatively an air cylinder may be substituted for the spring, acting as an air-spring. It is further contemplated that air cylinder may be utilized as a lock-out device. For instance, actuating the air cylinder in the opposite direction may prevent a cam lever from moving by holding the follower at the cam's major radius. Electric solenoids may be utilized to lock-out motions. Although a spring may be required for cam mechanism, a solenoid may produce more a rapid cutting motion than an air cylinder and require less maintenance.

Figure 8:
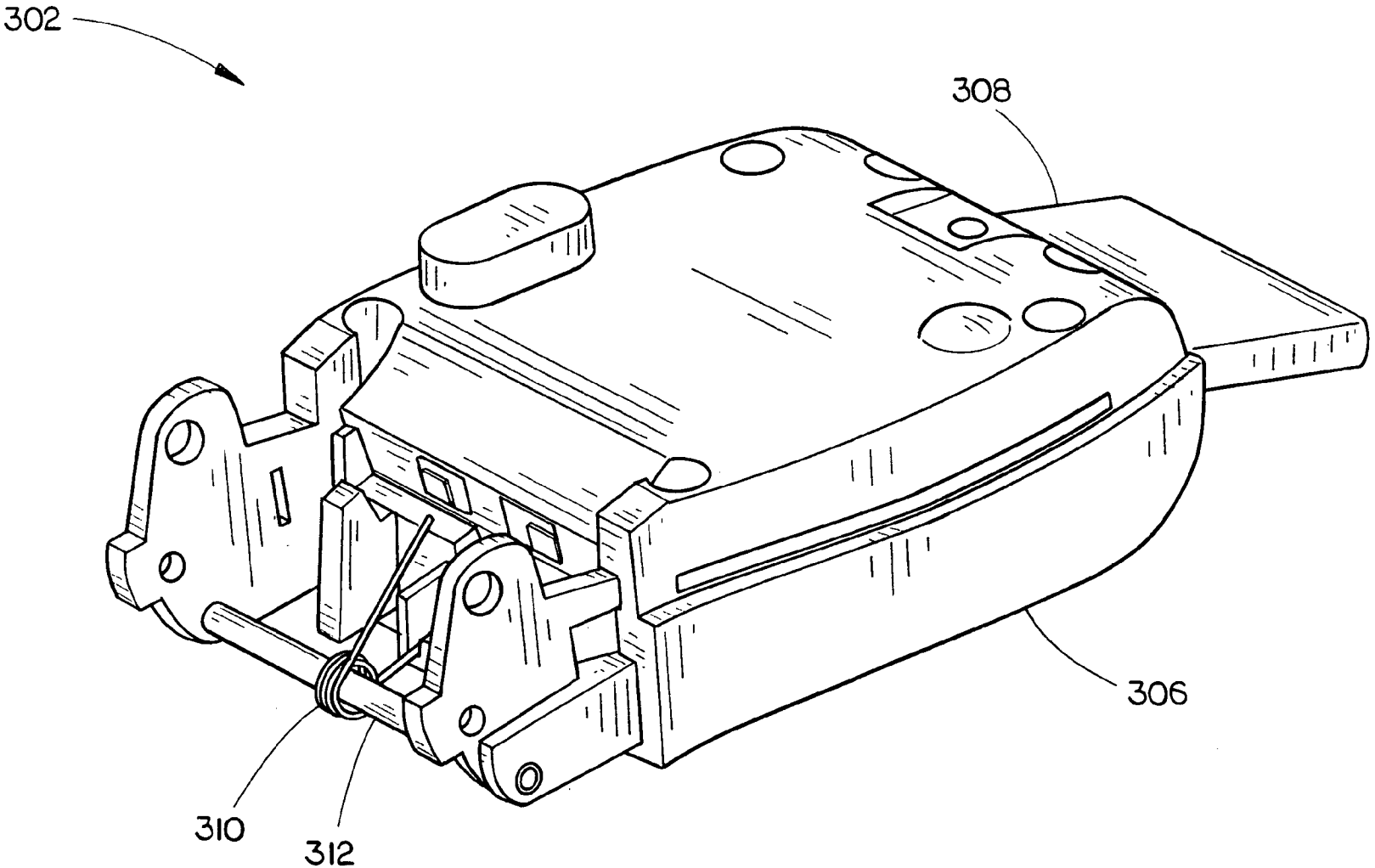
FIG. 8 is a bottom isometric view of an exemplary transceiver assembly of a wireless tether assembly in accordance with an embodiment of the present invention.
Figure 9:
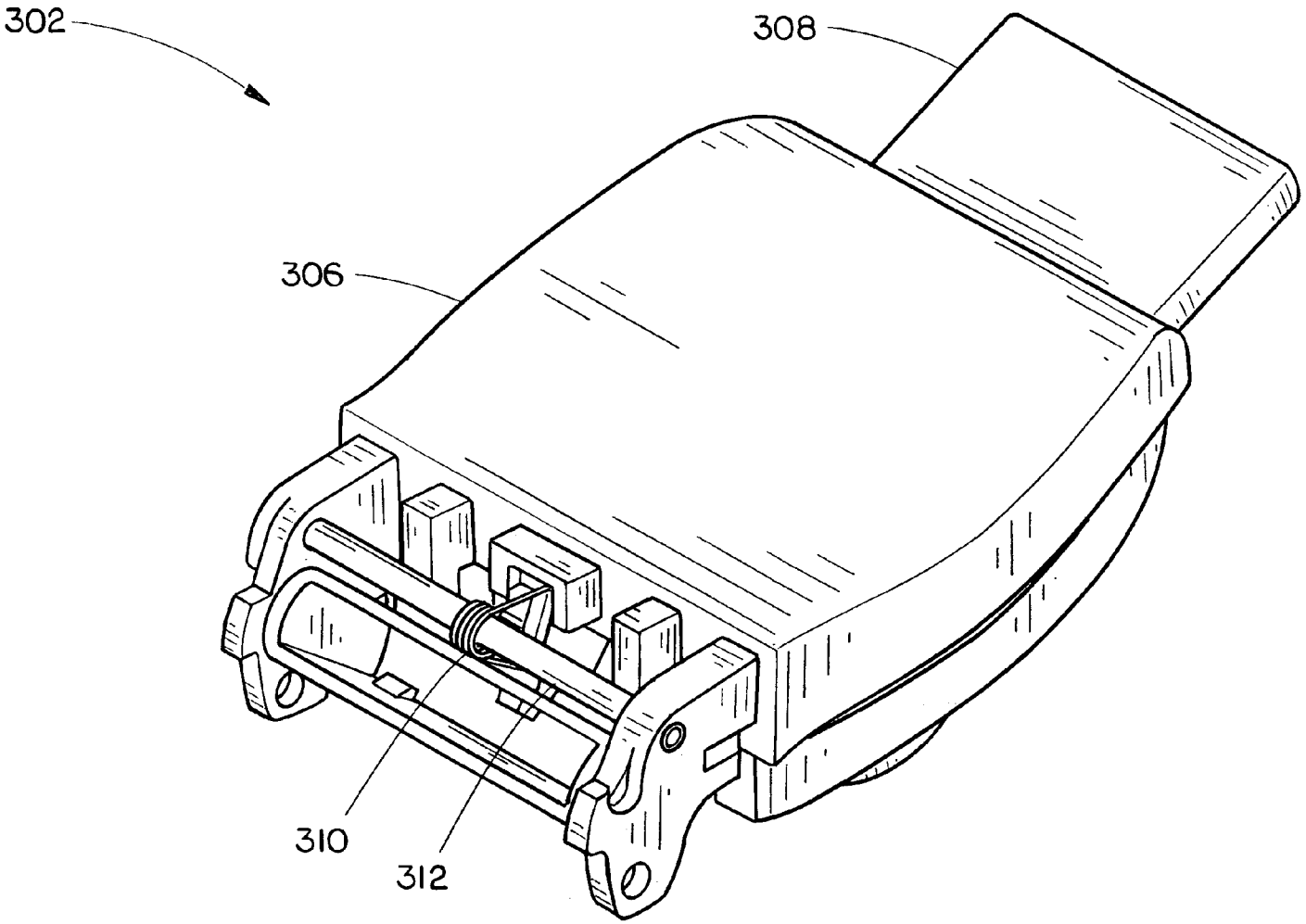
FIG. 9 is a top isometric view of a transceiver assembly in a closed position in accordance with an embodiment of the present invention.
Figure 10:
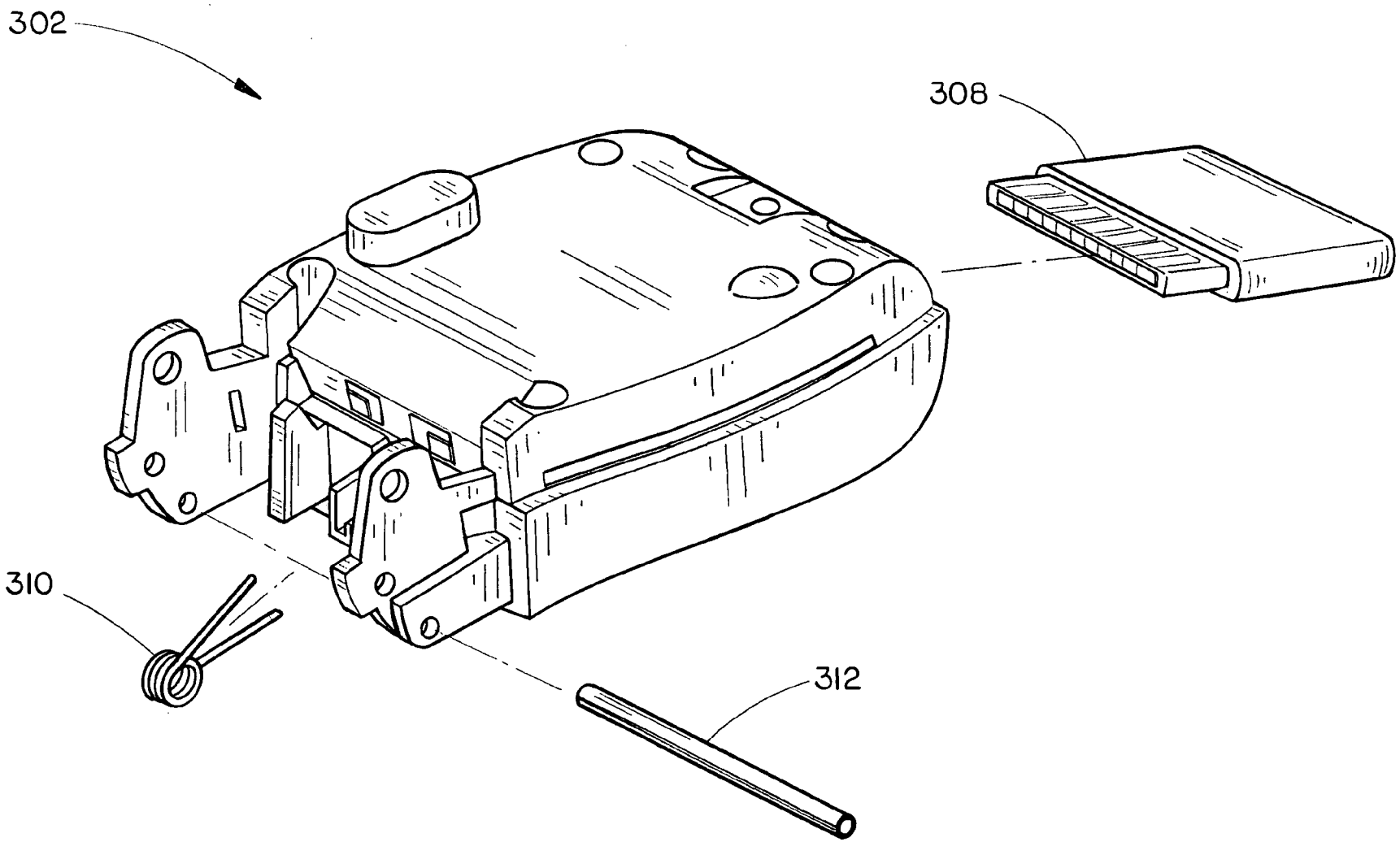
FIG. 10 is an isometric view of a partially disassembled transceiver assembly of a wireless tether assembly in accordance with an exemplary embodiment of the present invention.
Figure 11:
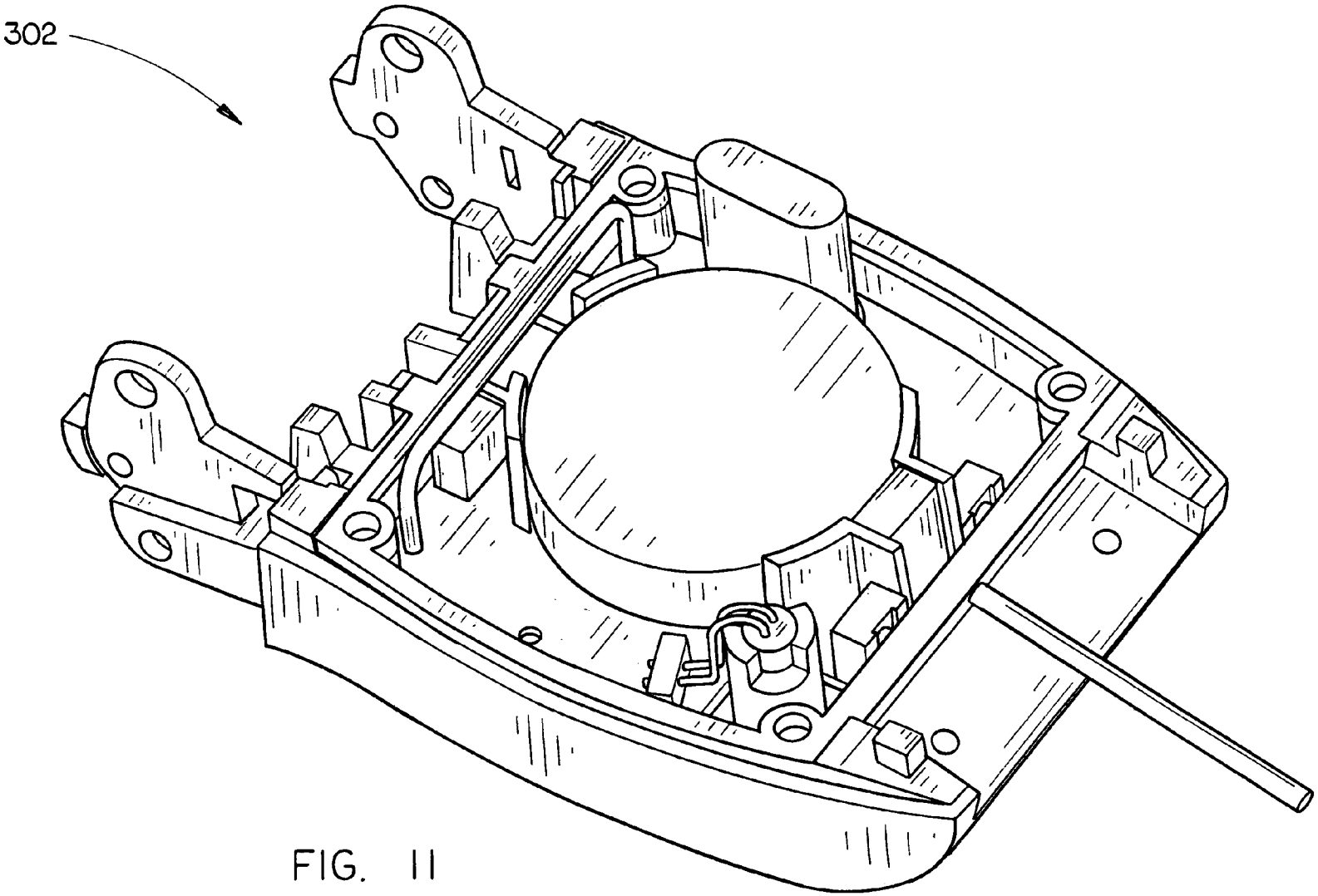
FIG. 11 is an isometric view showing internal components a transceiver assembly of a wireless tether assembly in accordance with an exemplary embodiment of the present invention.

Referring to FIGS. 8-10, wireless tether assembly may be further comprised of a securing mechanism for securing a wireless tether assembly housing 306. In one embodiment, securing mechanism may be a unidirectional springing tension mechanism 310 coupled to a rod 312 that may be inserted when the wireless tether assembly housing 306 has been closed. Springing tension mechanism 310 may prevent a wireless tether assembly housing 306 from reopening upon closure. It is further contemplated that any locking mechanism may secure a wireless tether assembly.

Figure 12:
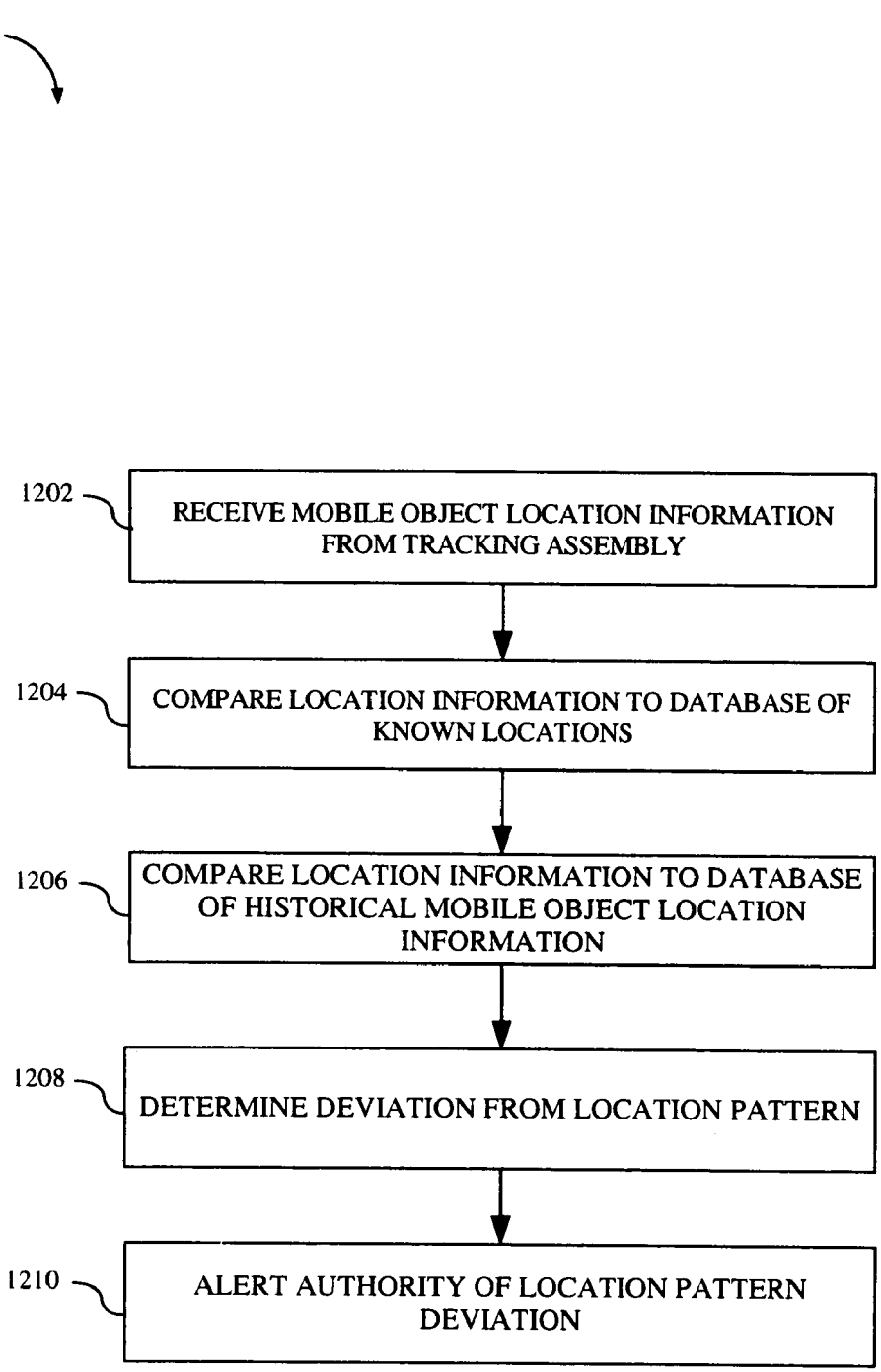
FIG. 12 is a flowchart representing a process for reviewing offender movement information in accordance with the present invention.

Referring to FIG. 12, a flowchart depicting a process 1200 for reviewing offender movement information in accordance with the present invention is shown. Process 1200 may include sub-processes for tracking the geographic location of a mobile assembly, reporting specific activities and identifying violations against established parameters. Information determined from sub-processes may be delivered to an appropriate authority utilizing various methods, including e-mail, paging, faxing, web-based reports, and the like. In one embodiment, process 1200 may be comprised of receiving mobile object location information from the tracking assembly 1202. Location information may be compared to a database of known locations 1204. Location information may also be compared to a database of historical mobile object location information 1206. A deviation may be determined from a location pattern 1208 determined from location information analysis. If a deviation is determined, an authority may be alerted of the location pattern deviation 1210.

Figure 13:
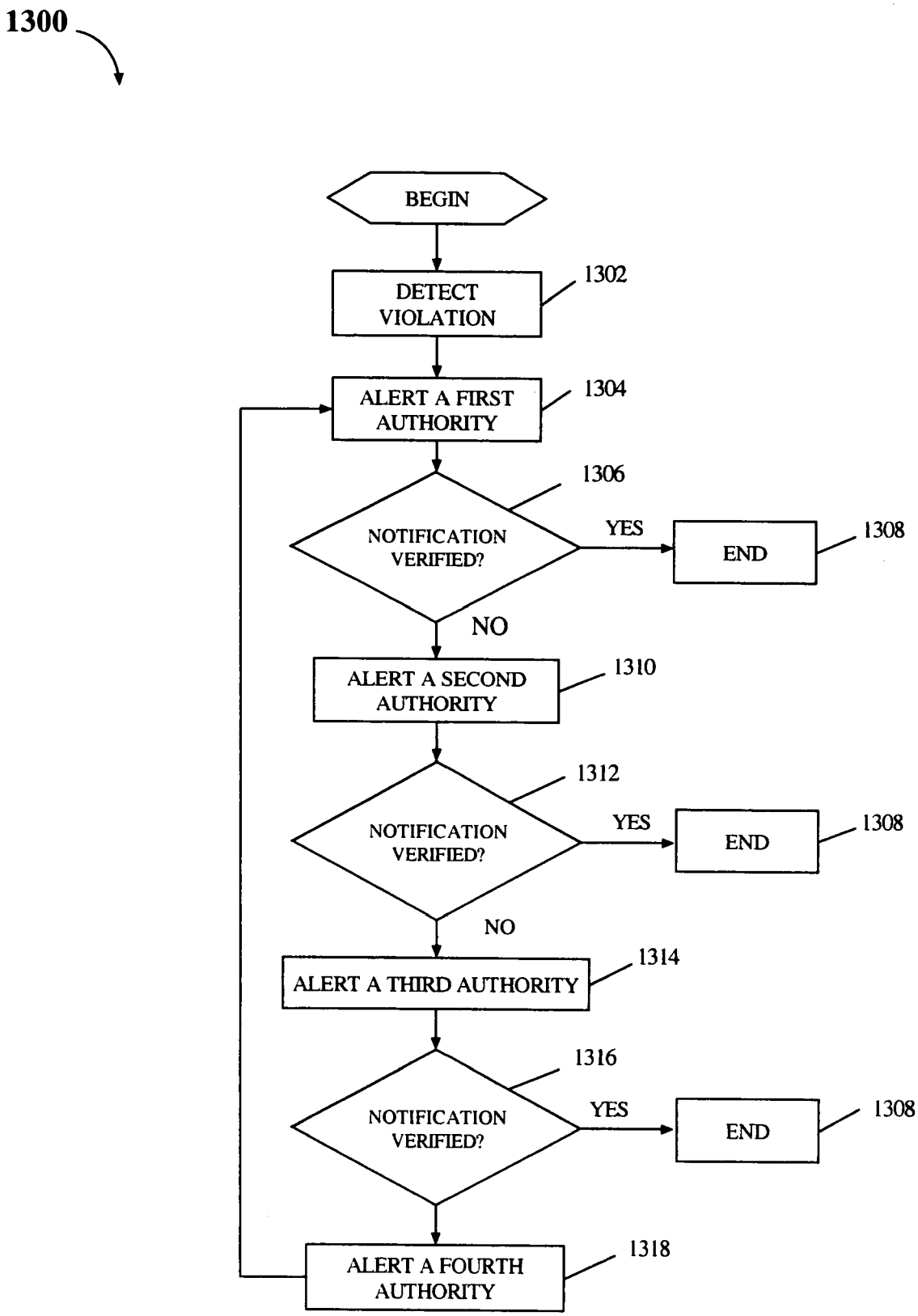
FIG. 13 is a flowchart representing a process for notification escalation in accordance with an exemplary embodiment of the present invention.

Referring generally to FIG. 13, a process 1300 for notification escalation is shown. Process 1300 for notification escalation may provide enhanced authority alert and situation resolution if a violation is detected. Notification escalation may refer to escalating notification to a higher authority upon receiving a no response indication from a notified party. Notification may be escalated to a subsequent party in a determined chain of authorization upon non-response from a previous party within a determined period of time. For example, a parole officer may be notified of a detected parolee violation. A parole officer may then be required to respond within 60 seconds of notification. Should a parole officer fail to respond, method may alert a police station located in the vicinity of a violating parolee. If a local police station fails to respond to an alert message within a determined amount of time, alternative authorities may be notified until a violation situation has been resolved. In one embodiment, notification escalation process may begin with the detection of a violation 1302. A first authority may be notified of the violation 1304. If a first authority verifies the notification 1306, process 1300 may terminate 1308. If a notification is not verified, a second authority may be alerted 1310. If a second authority verifies notification of an alert 1312, process 1300 may terminate 1308. If a second authority does not verify notification, a third authority may be alerted 1314. A third authority may verify notification of the alert 1316, and process 1300 may terminate 1308. However, if a third authority does not verify notification of the alert, a fourth authority may be alerted 1318. Process 1300 may begin again, providing an alert to a first authority 1304. Alternatively, process 1300 may continue to alert a fifth, sixth, seventh and the like authority until a violation notification is verified and a violation is resolved.

Although the present invention for purpose of explanation has been described with reference to specific exemplary embodiments, it will be understood that the invention is not limited to the embodiments described herein. A person of ordinary skill in the art would understand that the present invention can be practiced with modifications and alternations to those embodiments or can be practiced in other embodiments within the spirit and scope of the appended claims.

Moreover, non-dependent acts may be performed in parallel. The embodiments were chosen and described in order to best explain the principles of the invention and its practical applications, to thereby enable others skilled in the art to best utilize the invention and various embodiments with various modifications as are suited to the particular use contemplated.

Furthermore, the use of the phrase "one embodiment" throughout does not necessarily mean the same embodiment. Although these particular embodiments of the invention have been described, the invention should not be limited to these particular embodiments. Accordingly, the specification and drawings are to be regarded in an illustrative sense rather than a restrictive sense.

Moreover, the teachings of this invention can be adapted to a variety of storage system architectures including, but not limited to, a network-attached storage environment and a storage area network. The term "storage system" should therefore be taken broadly to include such arrangements in addition to any subsystems configured to perform a storage function and associated with other equipment or system.

Unless specifically stated otherwise, it is to be appreciated that throughout the discussions utilizing terms such as "processing" or "computing" or "calculating" or "determining" or "displaying" or the like refer to the action and processes of a computer system or similar electronic computing device that manipulates and transforms data represented as physical (e.g. electronic) quantities within the computer systems registers and memories into other data similarly represented as physical quantities within the computer system.

The present invention can be implemented by an apparatus for performing the operations herein. This apparatus may be specially constructed for the required purposes or it may comprise a machine, such as a general-purpose computer selectively activated or reconfigured by a computer program (such as a collection of instructions for execution by a machine or processor for example) stored in the computer. Such a computer program may be stored in a computer readable storage medium, such as, but not limited to any type of disk including floppy disks, optical disks, magnetic optical disks, read-only memories, random access memories, EPROMS, EEPROMS, magnetic or optical cards or any type of media suitable for storing physical (e.g. electronic) constructions and each coupled to a computer system bus. Each of these media may be coupled to a computer system bus through use of an appropriate device for reading and or for writing the media.

What is claimed:

1. An apparatus for monitoring a mobile object comprising:

a strap suitable for engaging with a portion of said mobile object, said strap comprising a tamper-detection assembly;

a transceiving assembly suitable for two-way communication;

a tamper resistant housing; said tamper resistant housing securing said transceiving assembly, wherein said tamper resistant housing further secures a first end and a second end of said strap with said portion of said mobile object; said tamper resistant housing comprising a partitioning assembly suitable for partitioning said strap.

2. The apparatus of claim 1, wherein said strap further comprises optical tamper detection.

3. The apparatus of claim 2, wherein said optical tamper detection is optical transmission pulse detection suitable for detecting the presence or absence of an optical pulse pattern.

4. The apparatus of claim 1, wherein said transceiving assembly further comprises a motion detector.

5. The apparatus of claim 4, wherein said motion detector is an accelerometer, a thermal, piezoelectric, gyroscopic or micro electrical mechanical motion detector.

6. The apparatus of claim 1, wherein said partitioning assembly further comprises a partitioning element suitable for partitioning said strap.

7. The apparatus of claim 6, wherein said partitioning assembly further comprises an actuating assembly suitable for initiating sufficient motion of said partitioning element to partition said strap.

8. The apparatus of claim 1, wherein said partitioning assembly includes a cam and lever mechanism suitable for initiating a blade motion for partitioning said strap.

9. The apparatus of claim 1, wherein said apparatus is reusable by replacement of said strap by a second strap.

10. An apparatus for monitoring a mobile object comprising:

a strap suitable for engaging with a portion of said mobile object, said strap comprising a plurality of grooves;

a transceiving assembly suitable for two-way communication; and a housing; said housing securing said transceiving assembly, said housing comprising a zip tie mechanism for securing said strap through a groove of said plurality of grooves, said housing further comprising a partitioning assembly suitable for partitioning said strap.

11. The apparatus of claim 10, wherein said strap further comprises optical tamper detection.

12. The apparatus of claim 11, wherein said optical tamper detection is optical transmission pulse detection suitable for detecting the presence or absence of an optical pulse pattern.

13. The apparatus of claim 9, wherein said partitioning assembly further comprises a partitioning element suitable for partitioning said strap.

14. The apparatus of claim 12, wherein said partitioning assembly further comprises an actuating assembly suitable for initiating sufficient motion of said partitioning element to partition said strap.

15. An apparatus for monitoring a mobile object comprising:

a transceiving assembly suitable for two-way communication;

a strap suitable for engaging with a portion of said mobile object, said strap comprising a tamper-detection assembly and an antenna for said transceiving assembly;

a tamper-resistant housing; said housing securing said transceiving assembly, wherein said housing includes a securing mechanism for securing a first end and a second end of said strap with said portion of said mobile object; said housing comprising a partitioning assembly suitable for partitioning said strap.

16. The apparatus of claim 15, wherein said securing mechanism is a unidirectional springing tension mechanism coupled to a rod inserted within said housing.

17. The apparatus of claim 15, wherein said securing mechanism includes an air cylinder which prevents motion of a cam lever.

18. The apparatus of claim 15, wherein said securing mechanism includes an electric solenoid.

19. The apparatus of claim 15, wherein said transceiving assembly further comprises a motion detector.

20. The apparatus of claim 19, wherein said motion detector is an accelerometer, a thermal, piezoelectric, gyroscopic or micro electrical mechanical motion detector.

* * * * *